US005728050A

United States Patent [19]

Lin

[11] Patent Number: 5,728,050

[45] Date of Patent: Mar. 17, 1998

[54] MASSAGE/SLAP DEVICE

[76] Inventor: Jui-Hsing Lin, 37, Lane 566, Min-Shen South Road, Chia-Yi City, Taiwan

[21] Appl. No.: 827,413

[22] Filed: Mar. 27, 1997

[51] Int. Cl.[6] ..... A61H 23/00

[52] U.S. Cl. ..... 601/107; 601/120; 601/135; 601/137

[58] Field of Search ..... 601/80, 107, 111, 601/134–137, 125, 138, 119–121; 606/204

[56] References Cited

U.S. PATENT DOCUMENTS

| | | | |
|---|---|---|---|
| 193,449 | 7/1877 | Klemm | 601/107 |
| 1,254,974 | 1/1918 | Briggs | 601/107 X |
| 4,345,757 | 8/1982 | Lo Voi | 601/121 X |

FOREIGN PATENT DOCUMENTS

| | | | |
|---|---|---|---|
| 896405 | 11/1953 | Germany | 601/135 |
| 274306 | 7/1927 | United Kingdom | 601/107 |

*Primary Examiner*—Danton D. DeMille
*Attorney, Agent, or Firm*—Larson & Taylor

[57] ABSTRACT

A massage/slap device a slapping device, a sleeve, and a massage device. The slapping device includes a plurality of flexible slapping bars arranged in a bundle an end of which is securely attached to a first end of a seat. The sleeve includes a first end having a first threaded inner surface for removably engaging with a threaded second end of the slapping device and a second end having a second threaded surface. The massage device includes a first threaded end and a second threaded end each of which is removably engaged with the second threaded inner surface of the sleeve. A massage member extends longitudinally, outwardly from the first threaded end of the massage device.

4 Claims, 3 Drawing Sheets

MASSAGE/SLAP DEVICE

BACKGROUND OF THE INVENTION

1. Field of the Invention

The present invention relates to a massage/slap device which may provide massage, slapping, and point massage to the human body.

2. Description of the Related Art

U.S. Pat. No. 4,993,408 to Schweisfurth discloses a massage device for rolling massage of skin and reflex zones of the human body. The massage device includes at least one axis attached to a handle with massage rings arranged freely rotatably thereon, which each carry uniformly distributed needle tips in circumferential direction. Such a massage device merely provides a single massage function. The present invention is intended to provide a massage/slap device which may provide massage, slapping, and point massage to the human body.

SUMMARY OF THE INVENTION

A massage/slap device in accordance with the present invention comprises a slapping means, a sleeve, and a massage means. The slapping means includes a seat having a first end and a threaded second end. A plurality of flexible slapping bars are arranged in a bundle, and the bundle of slapping bars has a first end securely attached to the first end of the seat and a second end. A clamping ring is removably mounted around the second end of the bundle of slapping bars.

The sleeve includes a first end having a first threaded inner surface for removably engaging with the threaded second end of the slapping means and a second end having a second threaded surface. The massage means includes a first threaded end and a second threaded end each of which is removably engaged with the second threaded inner surface of the sleeve. A massage member extends longitudinally, outwardly from the first threaded and of the massage device.

The massage means may have a string mounted thereto such that the massage/slap device can be hung onto a wall when not in use. In addition, the clamping ring may include a threaded inner surface for removably engaging with the second threaded end of the massage means. Furthermore, the massage member may further comprise a point massage member formed on a distal end thereof to proceed with point massage.

Other objects, advantages, and novel features of the invention will become more apparent from the following detailed description when taken in conjunction with the accompanying drawings.

DESCRIPTION OF THE PREFERRED EMBODIMENT

Figure 1:
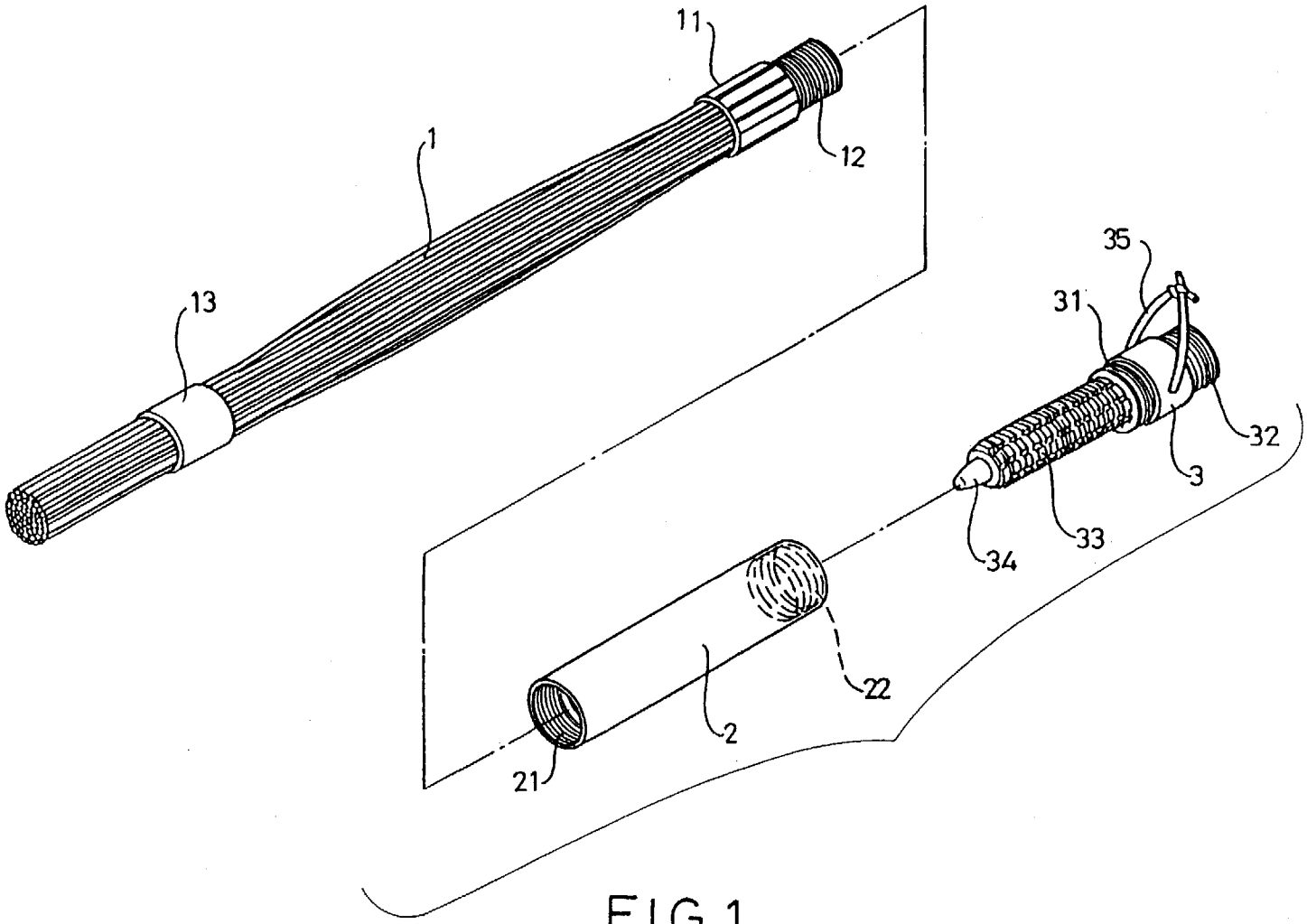
FIG. 1 is an exploded perspective view of a massage/slap device in accordance with the present invention.
Figure 2:
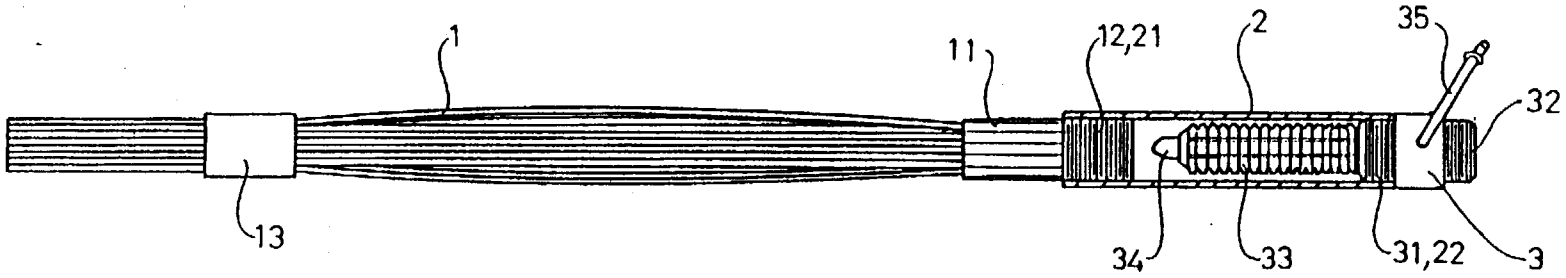
FIG. 2 is a sectional view of the massage/slap device in a storage status.

Referring to the drawings and initially to FIGS. 1 and 2, a massage/slap device in accordance with the present invention generally comprises a slapping means 1, a sleeve 2, and a massage means 3. The slapping means 1 includes a plurality of slapping bars arranged in a bundle an end of which is securely held in a seat 11 by punching. The slapping bars are made of flexible material, preferably metal. The seat 11 includes a first end to which the end of the bundle of slapping bars is securely attached and a threaded second end 12. A Clamping ring 13 is removably mounted around the bundle of slapping bars and includes a threaded inner surface.

The sleeve 2 is hollow and includes two ends each having a threaded inner surface 21, 22. The massage means 3 includes two threaded ends 31 and 32 for threading engagement with the threaded inner surface 22 of the sleeve 2. The massage means 3 further includes a massage member 33 which extends longitudinally, outwardly from the threaded end 31 and which includes a flat or waved surface. The massage member 33 is made of rigid or soft material. A point massage member 34 is formed on a distal end of the massage member 33. Preferably, a string 35 is provided on the massage means 3 such that the massage/slap device can be hung onto a wall when not in use.

The massage/slap device in FIG. 2 is in a storage status in which the threaded inner surface 21 of the sleeve 2 engages with the threaded second end 12 of the slapping means 1, the threaded end 31 of the massage means 3 engages with the threaded inner surface 22 of the sleeve 2 with the massage member 33 received in the sleeve 2, and the clamping ring 13 is mounted around an unfixed end of the bundle of slapping bars to prevent separation of the unfixed ends of the slapping bars. Thus, the massage/slap device occupies a relatively small space for easy carriage and storage.

Figure 3:
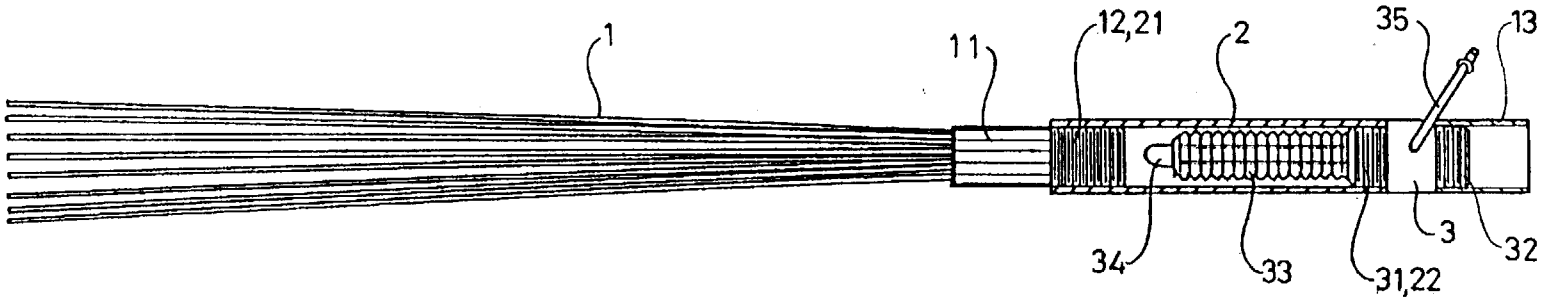
FIG. 3 is a sectional view of the massage/slap device in a status for slapping.
Figure 4:
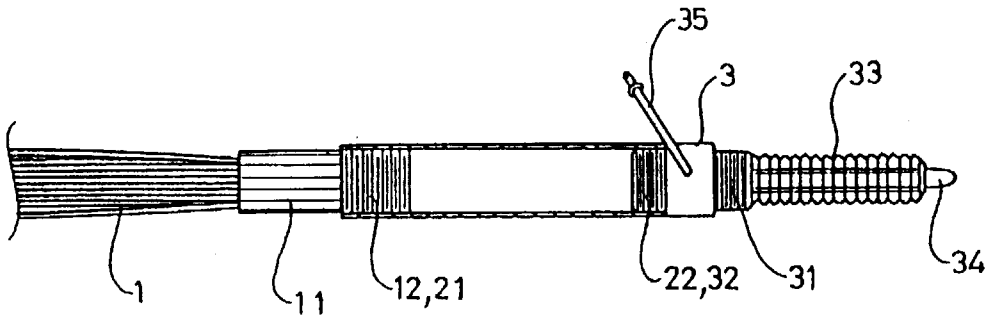
FIG. 4 is a sectional view of the massage/slap device in a status for massage.

The massage/slap device in FIG. 3 is in a status for slapping in which the clamping ring 13 is removed from the bundle of the slapping bars and engages with the threaded end 32 of the massage means 3. Thus, the unfixed ends of the slapping bars separate such that the user may hold the massage/slap device at the sleeve 2 and slap vital points of the human body.

The massage/slap device in FIG. 3 is in a status for slapping in which the massage member 33 and the point massage member 34 are exposed as the threaded end 32 of the massage means 3 engages with the threaded inner surface 22. The user may massage his body with the massage member 33 or proceed with point massage with the point massage member 34.

According to the above description, it is appreciated that the present invention provides multi-functions, i.e., massage, point massage, and slapping.

Although the invention has been explained in relation to its preferred embodiment, it is to be understood that many other possible modifications and variations can be made without departing from the spirit and scope of the invention as hereinafter claimed.

What is claimed is:

1. A massage/slap device, comprising:

a slapping means including a seat having a first end and a threaded second end, a plurality of flexible slapping bars arranged in a bundle, the bundle of slapping bars having a first end securely attached to the first end of the seat and a second end, and a clamping ring removably mounted around the second end of the bundle of slapping bars;

a sleeve including a first end having a first threaded inner surface for removably engaging with the threaded second end of the slapping means and a second end having a second threaded surface; and a massage means including a first threaded end and a second threaded end each of which is removably engaged with the second threaded inner surface of the sleeve, and a massage member extending longitudinally, outwardly from the first threaded end.

2. The massage/slap device according to claim 1, wherein the massage means further comprises a string mounted thereto.

3. The massage/slap device according to claim 1, wherein the clamping ring includes a threaded inner surface for removably engaging with the second threaded end of the massage means.

4. The massage/slap device according to claim 1, wherein the massage member further comprises a point massage member formed on a distal end thereof.

* * * * *